US010399580B2

(12) United States Patent
Brook et al.

(10) Patent No.: US 10,399,580 B2
(45) Date of Patent: Sep. 3, 2019

(54) PROCESS FOR PRODUCING A COUPLER KNUCKLE AND IMPROVED COUPLER KNUCKLE

(71) Applicant: Pennsy Corporation, West Chester, PA (US)

(72) Inventors: Zachary Ryan Brook, Leola, PA (US); Manuel Tavares, Doylestown, PA (US)

(73) Assignee: Pennsy Corporation, West Chester, PA (US)

( * ) Notice: Subject to any disclaimer, the term of this patent is extended or adjusted under 35 U.S.C. 154(b) by 1199 days.

(21) Appl. No.: 14/171,700

(22) Filed: Feb. 3, 2014

(65) Prior Publication Data

US 2014/0217051 A1 Aug. 7, 2014

Related U.S. Application Data

(63) Continuation-in-part of application No. 13/842,229, filed on Mar. 15, 2013, now Pat. No. 9,199,652, which is a continuation-in-part of application No. 13/678,021, filed on Nov. 15, 2012, now abandoned.

(51) Int. Cl.

| | |
|---|---|
| ***B22C 7/02*** | (2006.01) |
| ***B22C 9/04*** | (2006.01) |
| ***B22C 9/22*** | (2006.01) |
| ***B22D 25/02*** | (2006.01) |
| ***B61G 3/04*** | (2006.01) |
| ***B22D 23/02*** | (2006.01) |

(52) U.S. Cl.

CPC ..... *B61G 3/04* (2013.01); *B22C 7/02* (2013.01); *B22C 7/026* (2013.01); *B22C 9/046* (2013.01); *B22C 9/22* (2013.01); *B22D 23/02* (2013.01); *B22D 25/02* (2013.01)

(58) Field of Classification Search

CPC ..... B22C 9/04; B22C 9/046; B22C 7/005; B22C 7/02; B22C 7/023; B22C 7/026

See application file for complete search history.

(56) References Cited

U.S. PATENT DOCUMENTS

| | | | | |
|---|---|---|---|---|
| 2,088,135 A | | 7/1937 | Johnson et al. | |
| 2,688,412 A | | 9/1954 | Kulieke | |
| 3,635,280 A | * | 1/1972 | Parsons | B22C 7/026 156/293 |
| 3,853,228 A | | 12/1974 | Metzger | |
| 4,206,849 A | | 6/1980 | Kaim | |
| 4,605,133 A | | 8/1986 | Altherr | |
| 4,640,422 A | | 2/1987 | Elliott | |
| 4,645,085 A | | 2/1987 | Hanula et al. | |

(Continued)

*Primary Examiner* — Kevin P Kerns
*Assistant Examiner* — Jacky Yuen
(74) *Attorney, Agent, or Firm* — Bonini IP Law, LLC; Frank J. Bonini, Jr.

(57) ABSTRACT

A process for producing a coupler knuckle and an improved coupler knuckle design are provided. The process produces a coupler knuckle by constructing a mold having the shape of the coupler knuckle. The mold is coated with a material that is resistant to melting at the molten melt temperatures of the molten metal used to form the knuckle. With the mold coated, the cavities in the mold interior are filled by placing an inert material therein. The molten metal used for forming the knuckle contacts the mold and consumes it, while the coating serves to provide a shape for the knuckle.

40 Claims, 7 Drawing Sheets

(56) References Cited

U.S. PATENT DOCUMENTS

| | | | | |
|---|---|---|---|---|
| 4,987,945 | A * | 1/1991 | Corbett | B22C 7/026 164/235 |
| 5,582,307 | A | 12/1996 | Hawthorne et al. | |
| 5,878,897 | A * | 3/1999 | Lazzaro | B61G 3/06 213/139 |
| 6,129,227 | A | 10/2000 | Openchowski et al. | |
| 7,302,944 | B2 | 12/2007 | Judson | |
| 7,337,826 | B2 | 3/2008 | Mautino et al. | |
| 8,196,762 | B2 | 6/2012 | Smerecky | |
| 8,201,613 | B2 | 6/2012 | Marchese et al. | |
| 8,297,455 | B2 | 10/2012 | Smyth | |
| 8,302,790 | B2 | 11/2012 | Dumey | |
| 8,408,407 | B2 | 4/2013 | Nibouar et al. | |
| 8,485,371 | B2 | 7/2013 | Nibouar et al. | |
| 8,499,819 | B2 | 8/2013 | Nibouar et al. | |
| 8,631,952 | B2 | 1/2014 | Smerecky | |
| 8,646,631 | B2 | 2/2014 | Marchese et al. | |
| 8,662,327 | B2 | 3/2014 | Nibouar | |
| 8,695,818 | B2 | 4/2014 | Nibouar et al. | |
| 2005/0178521 | A1* | 8/2005 | Grassi | B22C 9/046 164/34 |
| 2009/0242160 | A1* | 10/2009 | Obara | B22C 9/046 164/24 |
| 2011/0068077 | A1* | 3/2011 | Smyth | B61G 3/04 213/155 |
| 2013/0177469 | A1* | 7/2013 | Ruhlman | C22C 35/005 420/82 |

* cited by examiner

PROCESS FOR PRODUCING A COUPLER KNUCKLE AND IMPROVED COUPLER KNUCKLE

BACKGROUND OF THE INVENTION

1. Field of the Invention

The present invention relates to the field of coupler knuckles for use in coupling railroad cars and to methods for producing coupler knuckles.

2. Brief Description of the Related Art

Railroad vehicles are generally connected together with couplers. Railroad couplers are typically constructed to railroad standards so that couplers used on railroad cars may be coupled together, even if produced by different manufacturers. Common knuckles are American Association of Railroads ("AAR") Standard E and F type railroad car couplers, and, in particular, the knuckles used in these couplers.

Railcar couplers are disposed at each end of a railway car to enable joining one end of such railway car to an adjacently disposed end of another railway car. The engageable portions of each of these couplers are known in the railway art as a knuckle. For example, railway freight car coupler knuckles are disclosed in numerous U.S. patents, such as, for example, including in the following U.S. patent documents: U.S. Pat. Nos. 461,312; 533,985; 693,998; 2,689,051; 2,088,135; 4,024,958; 4,206,849; 4,605,133; 5,582,307; 8,297,455 and U.S. patent application no. 2009/0289024. In addition, lightweight railway freight car coupler knuckles are disclosed in U.S. Pat. Nos. 5,954,212 and 6,129,227.

Coupler knuckles are generally manufactured from cast steel weighing approximately 84 lbs. The cast steel used is grade E, tensile strength 120,000 psi, yield strength of 100,000 psi, elongation of 14%, reduction of area 30%. These knuckles fatigue crack over time, which eventually leads to knuckle failure.

Knuckle failure accounts for about 100,000 train separations a year, or about 275 separations per day. Most of these separations occur when the train is out of a maintenance area. In such cases, a replacement knuckle, which can weigh about 80 pounds, must be carried from the locomotive at least some of the length of the train, which may be up to 25, 50 or even 100 railroad cars in length. The repair of a failed coupler knuckle can be labor intensive, can sometimes take place in very inclement weather, can cause train delays and, due to its excessive weight, subjects the carrier or carriers to potential lifting related injuries.

The front core of a knuckle is commonly referred to as the finger core. The finger core is commonly constructed to produce an internal cavity having thin ribs. These ribs made out of the standard grade E cast steel have demonstrated a weakness to the load environment with the development of fatigue and/or hot tear cracks. The fatigue cracks can grow over time and eventually lead to knuckle failure which results in separation of railcars. Separately, internal or external cracks in the knuckle are a cause for replacement of the knuckle. The rear core of a knuckle is commonly referred to as the kidney core. Knuckles can sometimes break within this portion of the knuckle and this has proven to be a very undesirable location for a failure. A failure in this region of the knuckle can lead to knuckle jamming within the coupler body and prevent a change out of a failed knuckle, thereby requiring the entire coupler assembly to be replaced, a very costly repair.

The core of the finished knuckle is generally seen as a cavity in the knuckle. However, it is the practice of a knuckle that is cast to cast the knuckle around a core. The common practice is to utilize a core within the casting, and then break the core apart when the knuckle has been cast. This practice, aside from being time consuming, generally requires precise positioning of the core, such as, in a jig, and that the core remain in position during the casting process. The current methods used for forming knuckles have drawbacks and are known to produce failures in the final product when the core is misaligned or has shifted during the forming process. In some instances, the metal itself that is used for the casting may shift the core when it contacts it, leading to an unusable part. U.S. Pat. No. 2,088,135 discloses a car coupler or coupler knuckle that is made from a casting.

U.S. Pat. No. 8,297,455 discloses the use of investment casting as a way to attempt to alleviate the problems of utilizing cores and the potential for core shifting, and to avoid the parting line between mold sections. The '455 patent discloses an investment casting method in which a prototype of a knuckle is formed, the prototype is coated with a slurry forming a shell, and then the prototype is removed from the shell. The '455 patent discloses using wax as the prototype and that the wax is melted and removed from the shell leaving a cavity. The component is then cast in the shell.

There is a need for a process for producing a knuckle that may be done with improved precision and less waste, and for a knuckle having improved capabilities for handling forces and having improved strength or fatigue life.

In addition, there is a need for a lightweight knuckle that is lower in weight than conventional knuckles and with strength or fatigue life similar to or exceeding those of heavier knuckles, where the lightweight knuckle operates to be the weak link in the coupler system and fail under high loading conditions.

SUMMARY OF THE INVENTION

A process for producing a coupler knuckle and an improved coupler knuckle design are provided. According to one aspect of the invention, a process is implemented to produce a coupler knuckle where a mold having the shape of the coupler knuckle is constructed and used to form the knuckle. In accordance with the process, cavities may be produced in the knuckle including within the interior of the knuckle.

It is an object of the invention to provide an improved process for producing a coupler knuckle. It is a further object of the invention to provide an improved process for improving the formation of the coupler knuckle and to reduce loss of product formation previously caused by production errors and process inefficiencies.

It is another object of the invention to provide an improved process for producing a coupler knuckle which involves fewer and/or less costly steps than prior processes and which minimizes the tendency for undesirable material to be left behind in, and/or present in, a mold when the mold melt is introduced therein.

According to another object of the invention, an improved coupler knuckle is provided, wherein the coupler knuckle has improved force handling capabilities.

It is an object of the invention to produce an improved coupler knuckle that has an interior construction to facilitate improvements in force handling, receiving stresses, and transmission of force loads through the knuckle, including from one end of the knuckle to the other.

It is another object of the invention to provide an improved knuckle and a process for producing an improved knuckle, where the knuckle has increased fatigue resistance and improved strength.

It is another object of the invention to produce a knuckle that has a plurality of spaced apart layers in the knuckle interior which are separated by cavities.

It is another object of the invention to produce a knuckle that has improved strength without adding to the weight of the knuckle.

It is another object of the invention to provide a mold for a coupler knuckle, where the mold is constructed from mold components that when assembled together form a mold corresponding with the shape and volume of the coupler knuckle to be produced.

It is another object of the invention to provide a process for producing a lightweight knuckle and an improved lightweight knuckle that is suitably strong while also still allowing the knuckle to handle stress and force loads imparted thereon by the railway vehicle, its contents and adjoining vehicles or engines.

It is another object of the invention to provide an improved knuckle and a method for producing an improved knuckle that is reduced in weight while maintaining and/or improving the fatigue resistance of the knuckle.

It is a further object of the invention to provide a process for producing a knuckle that does not require the use of a core to form the knuckle.

These and other advantages are provided by the invention.

BRIEF DESCRIPTION OF THE DRAWING FIGURES

DETAILED DESCRIPTION OF THE PREFERRED EMBODIMENTS

Figure 1:
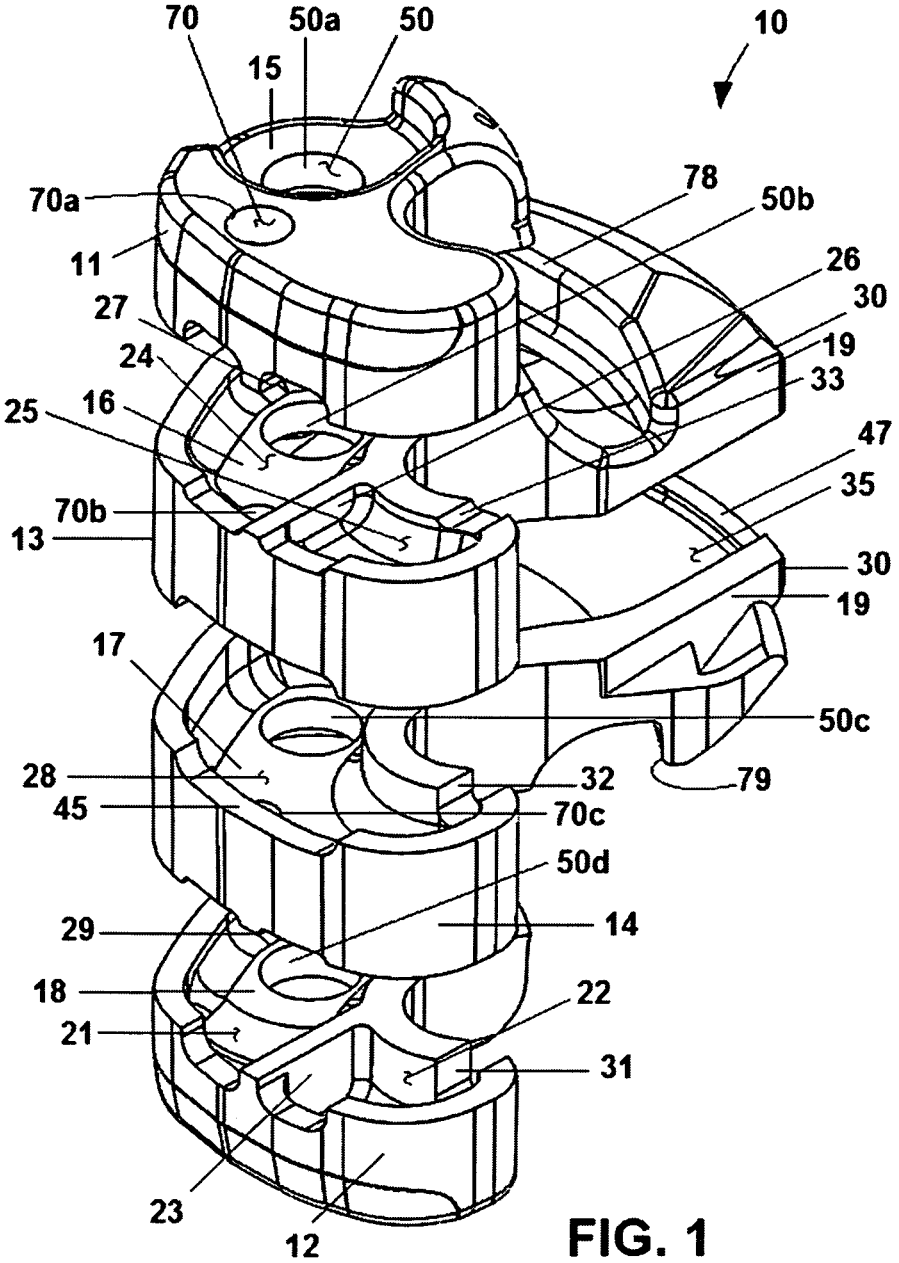
FIG. 1 is an exploded perspective view of a mold according to the present invention as viewed looking at the nose portion, the mold including a plurality of mold component sections.
Figure 2:
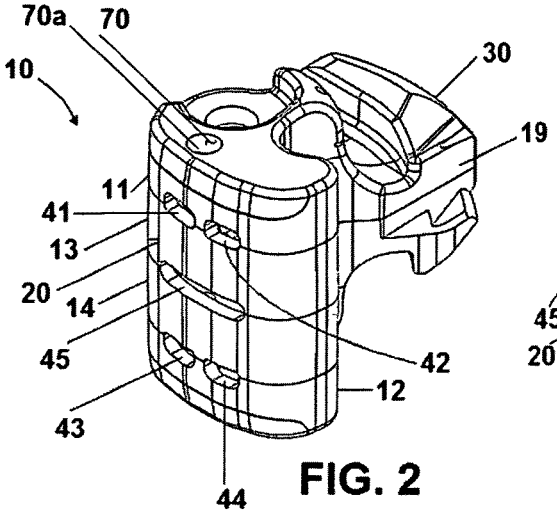
FIG. 2 is a perspective view of the mold of FIG. 1, shown with the mold components in an assembled condition.
Figure 3:
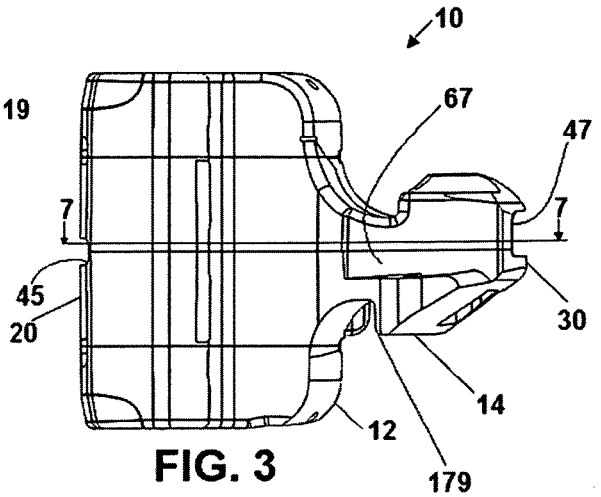
FIG. 3 is a right side elevation view of the mold of FIG. 2.
Figure 4:
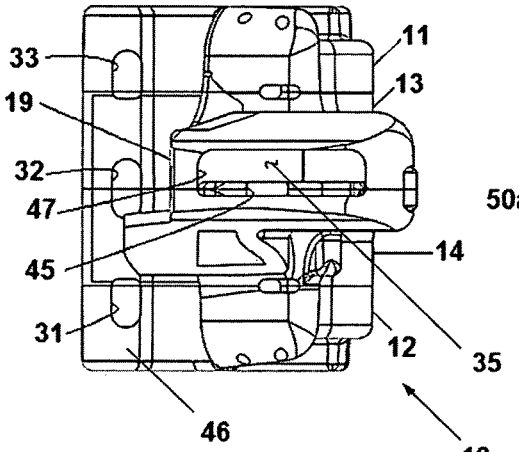
FIG. 4 is a front elevation view of the tail of the mold of FIG. 2.
Figure 5:
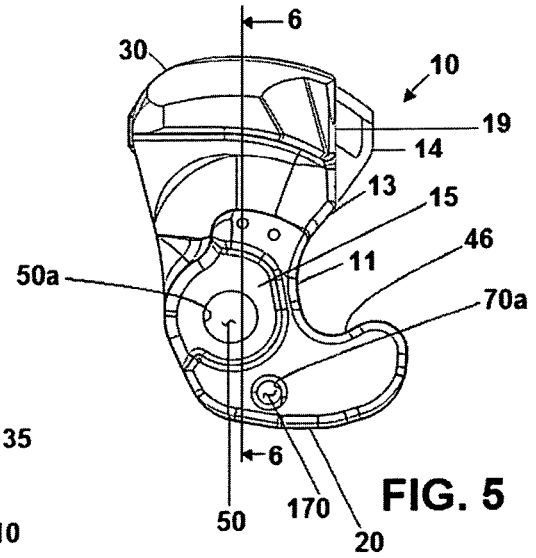
FIG. 5 is a top plan view of the mold of FIG. 1.
Figure 6:
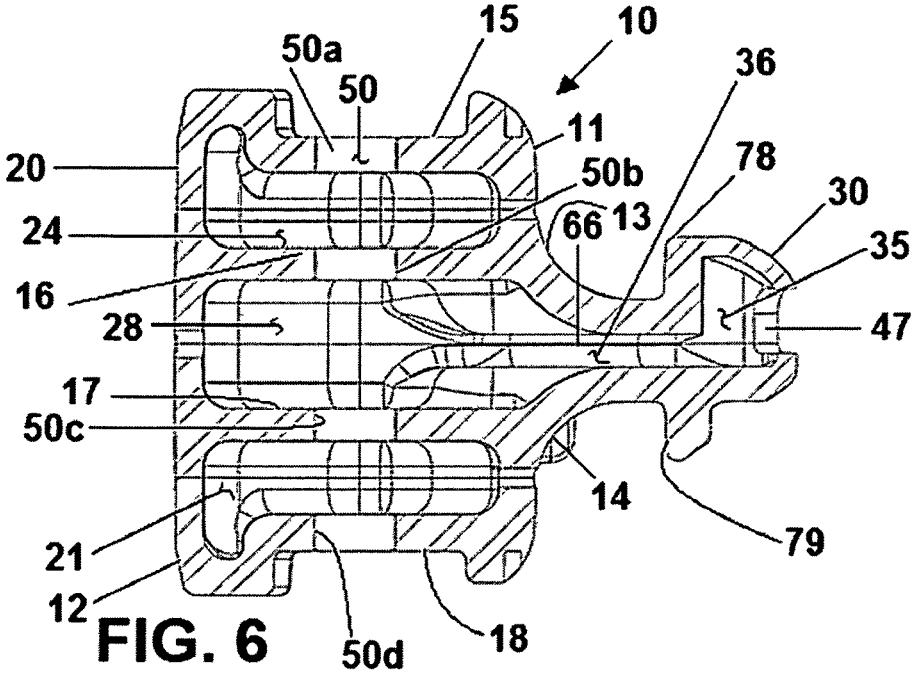
FIG. 6 is a vertical sectional view of the assembled mold components of FIG. 2, taken along the section line 6-6 of FIG. 5.

An improved coupler knuckle and process for producing a coupler knuckle are provided. FIGS. 1-7 illustrate a preferred embodiment of a mold 10 for producing a coupler knuckle. The mold 10 preferably may be used to form the coupler knuckle 110 shown in FIGS. 8-15 and described herein.

A mold 10 preferably is formed to resemble the shape of the knuckle that is to be produced using the mold 10. The mold 10 preferably also corresponds with the volume that forms the mass of the knuckle produced with the mold 10. According to preferred embodiments, a mold for producing a coupler knuckle may be constructed from a plurality of sections that may be assembled together to form the mold. According to the embodiment shown, the mold 10 is constructed from a plurality of mold component sections, and, according to a preferred exemplary embodiment, four mold component sections, including an upper mold component section 11, a lower mold component section 12, a first mid component section 13, and a second mid component section 14, are provided. The mold component sections 11,12,13,14 are produced in accordance with a suitable process which may include, injections molding, three-dimensional (3-D) printing, carving or other suitable forming procedure. The mold components 11,12,13,14 preferably are formed from a consumable material, such as, for example, decomposable material. According to a preferred embodiment, the decomposable material is a material that will decompose to gaseous or other product or products when contacted with the material that is used to form the knuckle. Preferably, the material used for forming the knuckle is a metal material, and may comprise steel or other suitable metal, alloy or mixture of metals. According to a preferred embodiment, the material used for forming the knuckle may be an austempered metal. The decomposable mold material preferably is a material that is lightweight and low in mass, and does not interfere with the formation of, or the finished knuckle. The material used for forming the knuckle with the mold 10 generally is supplied to the mold 10 as a molten material.

According to a preferred embodiment, the mold component sections 11,12,13,14 are arrangeable together to form a representation of the shape of the coupler knuckle to be produced. The mold 10 is configured having a plurality of layers that are spaced apart, which, in the embodiment illustrated, include a first layer 15, a second layer 16, a third layer 17 and a fourth layer 18. The layers 15,16,17,18 preferably are provided on each of the respective mold component sections 11,14,13,12. The mold 10 has at least one cavity therein, and preferably, the mold 10 has a plurality of cavities. According to the preferred embodiment illustrated, the mold component sections 11,12,13,14 are arranged together to form a plurality of cavities. A first plurality of cavities is formed in the nose section 20 and includes the lower nose cavities 21,22 formed between the lower mold component section 12 and the second mid component section 14. The lower nose cavities 21,22 are separated by a transverse wall 23. The transverse walls 23 and 29 span between the fourth or lower layer 18 and the third layer 17 and, according to a preferred embodiment, form a continuous wall therebetween. The first plurality of cavities in the nose section 20 also is shown including the upper nose cavities 24,25 separated by the transverse wall 26 of the first mid component section 13 and the transverse wall 27 of the upper mold component section 11, the transverse walls 26,27 spanning between the upper or first layer 15 and first mid layer 16. The upper nose cavities 24,25 are formed between the upper mold component section 11 and first mid component section 13. The first plurality of cavities in the nose section 20 is shown also including a mid cavity 28 disposed between the first mid component section 13 and the second mid component section 14. Additional cavities are formed in the mold 10, including a tail cavity 35 formed at the tail section 30. A plurality of openings are associated with the cavities and allow the cavities to communicate with the exterior of the mold 10. Openings 41,42,43,44,45 are provided in the mold 10 at the nose section 20, respectively, opening into the nose cavities 21,22,24,25,28. The mold 10 may be provided with openings 31,32,33 on or near the throat wall 46. Also shown is an opening 47 that opens into the tail cavity 35. The opening 47 preferably is formed between the first mid component section 13 and second mid component section 14 at the tail portions thereof. According to a preferred embodiment, the cavities that are provided in the mold 10 preferably are accessible through at least one or more of the openings, such as, for example, the openings 41,42,43,44,45 provided in the nose section 20 and the opening 47 provided in the tail section 30. According to a preferred embodiment, an opening communicates with at least one of or more of the mold cavities. A locking face 19 is shown provided on the tail section 30.

According to a preferred embodiment, the tail cavity 35 connects with a cavity or channel 36, which is shown communicating with a nose cavity, and preferably the mid cavity 28. A first sidewall portion 66 and second sidewall portion 67 (FIGS. 3 and 7) are provided between the nose portion 20 and tail portion 30, and are shown defining the channel or cavity 36.

The mold 10 also has a pin bore 50 therein. According to a preferred embodiment, the mold component sections 11,12,13,14 when arranged together form a pin bore 50, which extends through the mold structure. In the embodiment of the mold 10 illustrated, the pin bore 50 is formed in each of the spaced apart layers 15,16,17,18 of the mold component sections 11,12,13,14. A bore 50*a*,50*b*,50*c*,50*d*, is provided in each of the respective mold component sections 11,12,13,14. The bores 50*a*,50*b*,50*c*,50*d* are provided respectively in each layer 15,16,17,18. The bores 50*a*,50*b*,50*c*,50*d* are provided so that when the mold component sections 11,12,13,14 are arranged to form the mold, the pin bores 50*a*,50*b*,50*c*,50*d* are aligned to form a continuous pin bore 50 extending through the mold 10. In the embodiment of the mold 10 illustrated, the cavities 24,28,21 communicate with the pin bore 50.

The mold 10 also is shown including pulling lugs 78,79, which are provided at the tail section 30. According to a preferred embodiment of the mold 10, the upper lug 78 is part of the first mid component section 13 and the lower lug 79 is part of the second mid component section 14.

The mold 10 preferably includes a flag hole 70 that extends into the top layer 15 of the mold 10. The flag hole 70 may extend into the mold 10, and preferably may be formed by a plurality of flag holes 70*a*,70*b*,70*c* provided in the respective layers 15,16,17. According to a preferred embodiment, the flag hole extends to the lower layer 18, but not through it, while in alternate embodiments, the flag hole 70 may pass through the lower layer 18, or into it without extending through it.

The mold 10 and component sections 11,12,13,14 forming the mold 10 preferably are formed from a material that may readily decompose when contacted by the material that is used to form the resultant knuckle. According to preferred embodiments, the mold 10 and mold components 11,12,13,14 are formed from a decomposable material. According to a preferred embodiment, the mold components 11,12,13,14 are formed from a foam material. For example, one preferred material for forming the mold components 11,12,13,14 is a polystyrene foam. The mold 10, and mold sections forming the mold, such as those mold component sections 11,12,13,14 described herein in connection with a preferred embodiment, may be made by injection molding. The mold material may be injection molded to form the desired mold shape that corresponds with the shape and volume of the knuckle that is to be produced from the mold 10. Alternatively, the mold 10 may be formed by three dimensional (3-D) printing. Alternative means may be used to form the mold 10. For example, the mold 10 may be formed using another mold (a mold form or die), such as, for example, a ceramic, plastic or aluminum mold form or die. Another way in which the mold material may be used to form the mold 10 and mold component sections 11,12,13,14 is by using pre-expanded beads of material, such as polystyrene, which are placed in the mold form or die and processed using steam and/or heat and air to form a foamed polystyrene mold 10. This may be accomplished by injecting the mold material in bead form into the mold form or die, heating the mold form or die with a heat source and, alternately or in addition thereto, applying steam to cause the material, such as polystyrene, to expand more to fill the die or mold form. According to preferred embodiments, the resultant mold 10 may be composed of as little as 3%, or even less, of the solid material, such as polystyrene, with the rest of the mold composition being air. According to preferred embodiments, the mold 10 is formed from a plurality of sections, such as those mold component sections 11,12,13,14 shown and described herein in connection with the preferred embodiment. The preferably foam mold sections may be separately produced and assembled together to form the mold 10. The mold sections may be glued together in their aligned form to provide a mold 10 that may be used to produce a coupler knuckle.

The formed mold component sections 11,12,13,14, when arranged, form at least one, and, as shown in a preferred embodiment, a plurality of openings which enable communication into the mold cavities from outside the mold 10. The mold component sections 11,12,13,14, according to the preferred arrangement illustrated, define the exterior surfaces of the mold 10 as well as the interior of the mold, including interior surfaces. The cavities 21,22,24,25,28,35 are formed by the interior of the mold 10, and preferably are defined by the interior mold surfaces.

The mold 10 may be used to produce a coupler knuckle. According to a preferred method, the mold component sections 11,12,13,14 are assembled together in an aligned condition, and preferably are secured together (e.g., with a suitable adhesive). A coating is applied to the mold 10 so that the interior and exterior mold surfaces are covered. Preferably the coating is a refractory coating. The coating is applied to the mold 10 in order to form a solid, shape-retaining composition. The coating may be applied by brushing, spraying immersing, or other suitable application procedure. The coating, once applied and cured on the mold 10, preferably has a melting point higher than that of the molten material that is to be introduced into the mold 10 to form the coupler knuckle. The mold 10 is constructed to permit permeability of the decomposed mold material or by products thereof. According to a preferred embodiment, the coating preferably is permeable to the decomposed mold component sections, when they decompose, or by products of the mold decomposition. The coating is suitably resistant to heat and the material to which the formed coupler knuckle with be made, so that the coupler knuckle may be formed using the molten metal and the refractory coating is able to maintain the mold shape. One preferred example of a refractory coating is a ceramic coating.

Figure 7:
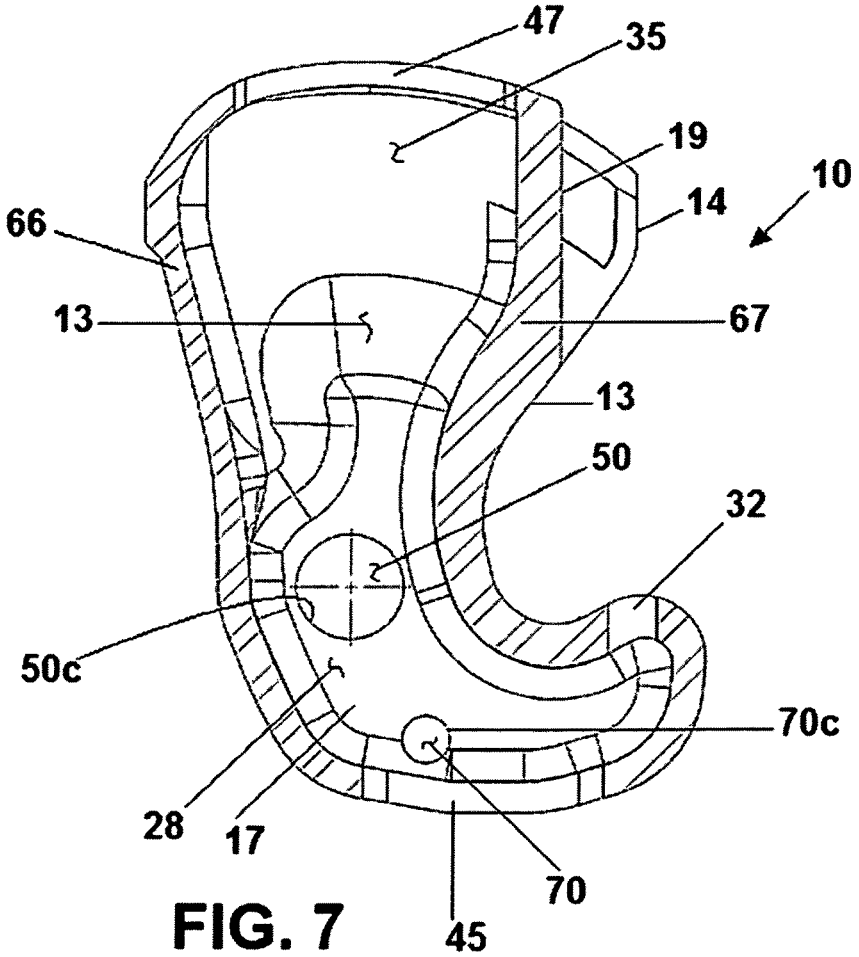
FIG. 7 is a transverse sectional view of the assembled mold components of FIG. 2, taken along the section line 7-7 of FIG. 3.
Figure 8:
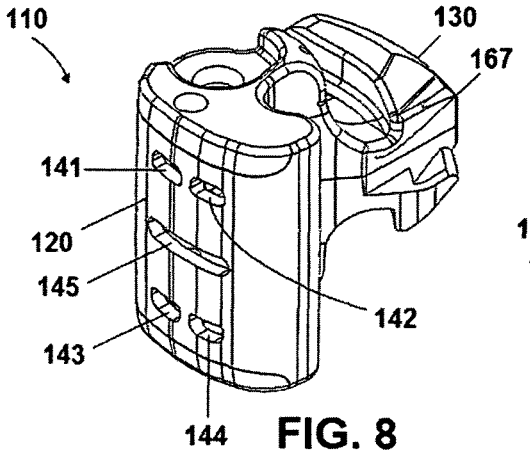
FIG. 8 is a perspective view of a knuckle according to a preferred embodiment of the invention.
Figure 9:
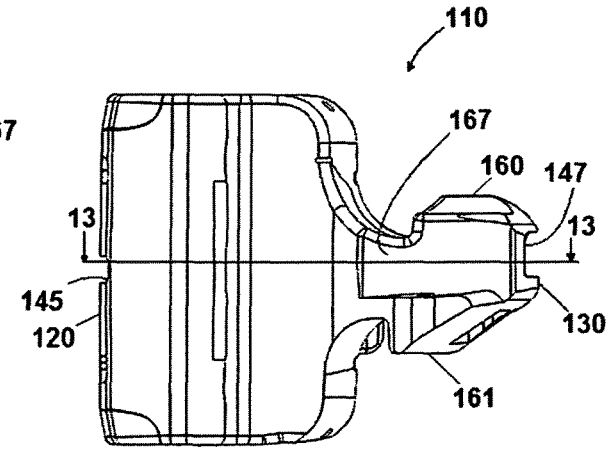
FIG. 9 is a right side elevation view thereof.
Figure 10:
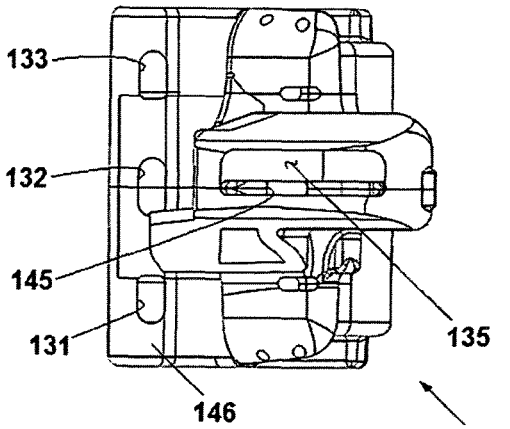
FIG. 10 is a front elevation view of the tail thereof.
Figure 11:
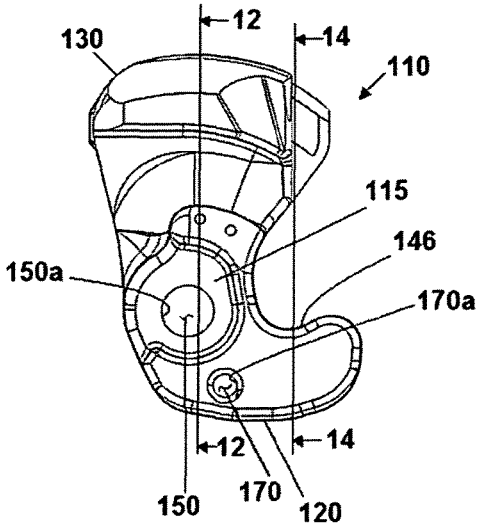
FIG. 11 is a top plan view thereof.
Figure 12:
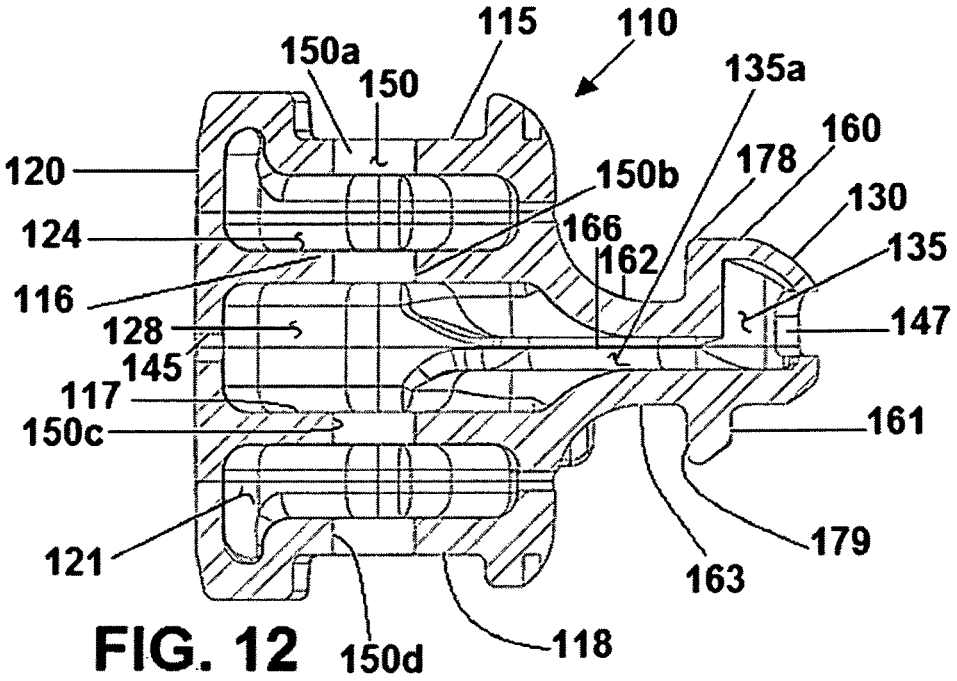
FIG. 12 is a vertical sectional view thereof taken along the section line 12-12 of FIG. 11.
Figure 13:
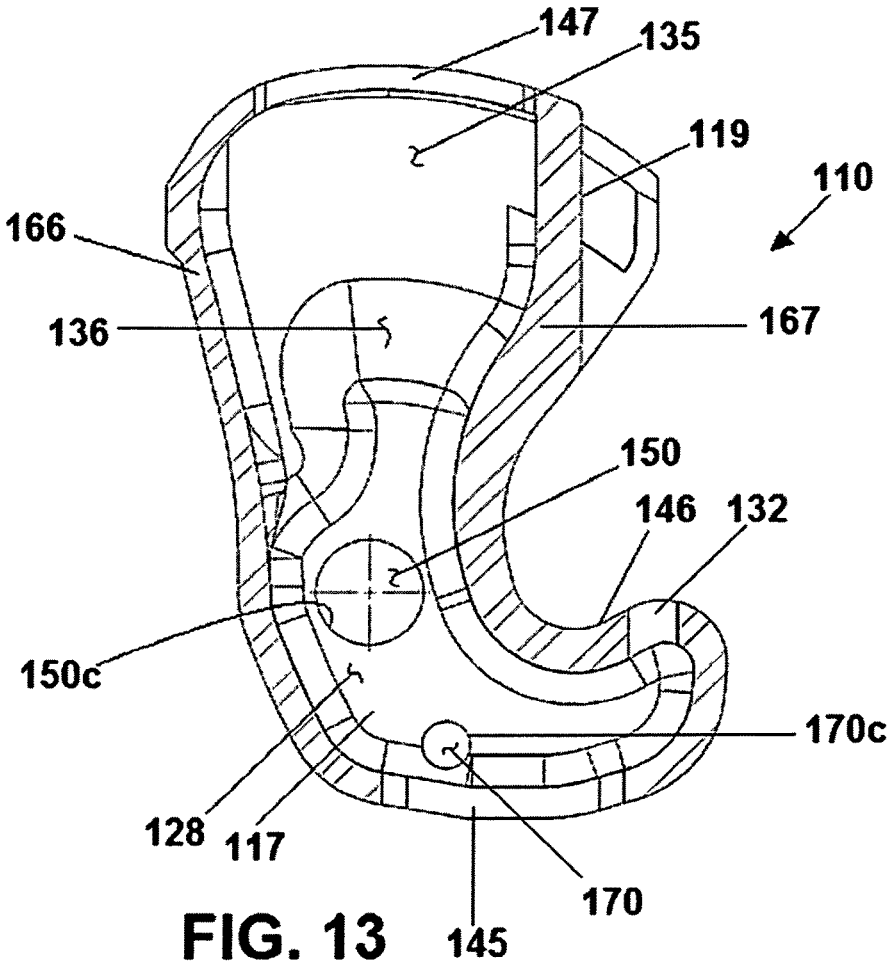
FIG. 13 is a transverse sectional view thereof, taken along the section line 13-13 of FIG. 9.
Figure 14:
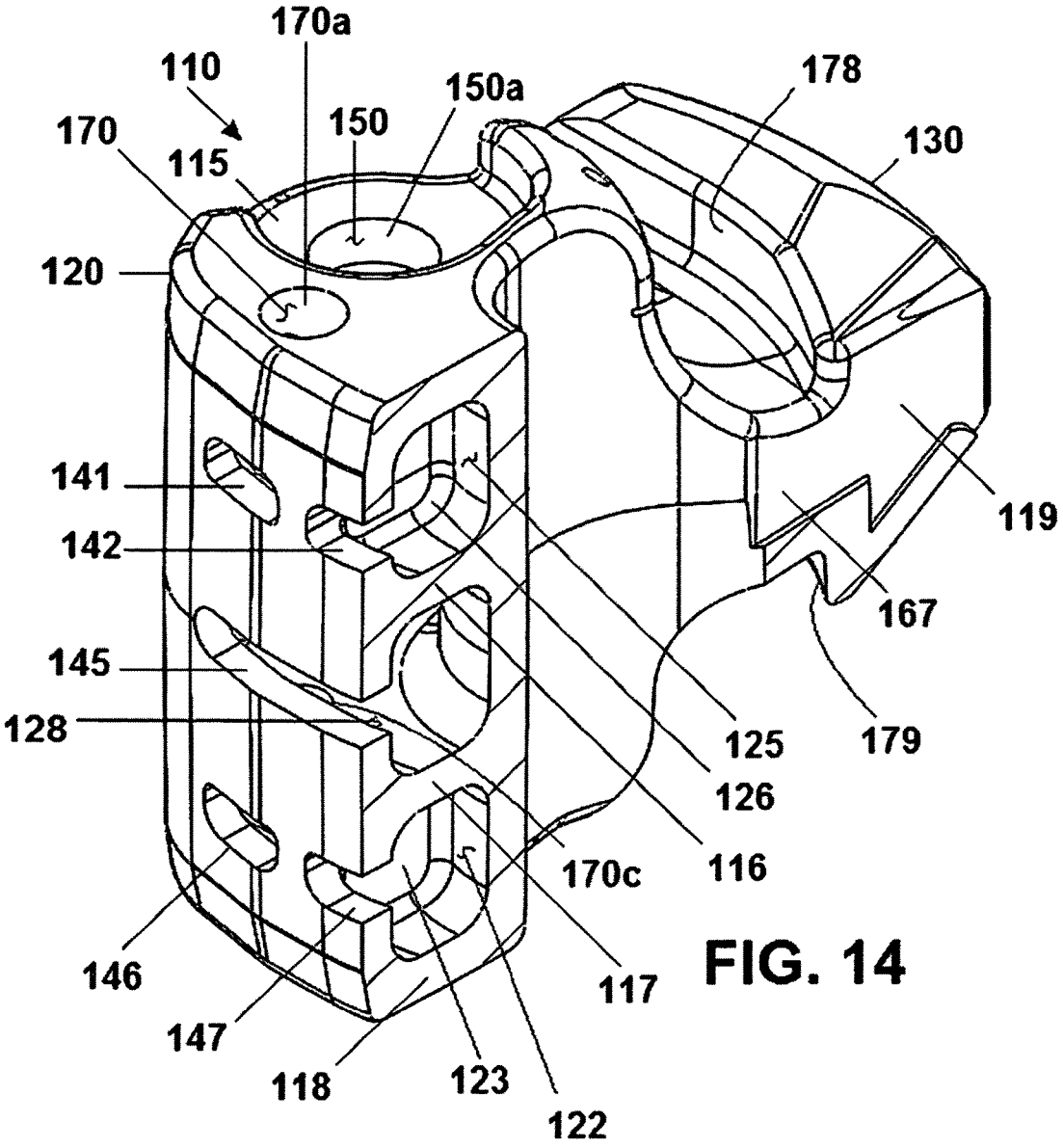
FIG. 14 is a sectional view thereof taken through the section line 14-14 of FIG. 11, as viewed in perspective looking from the nose.
Figure 15:
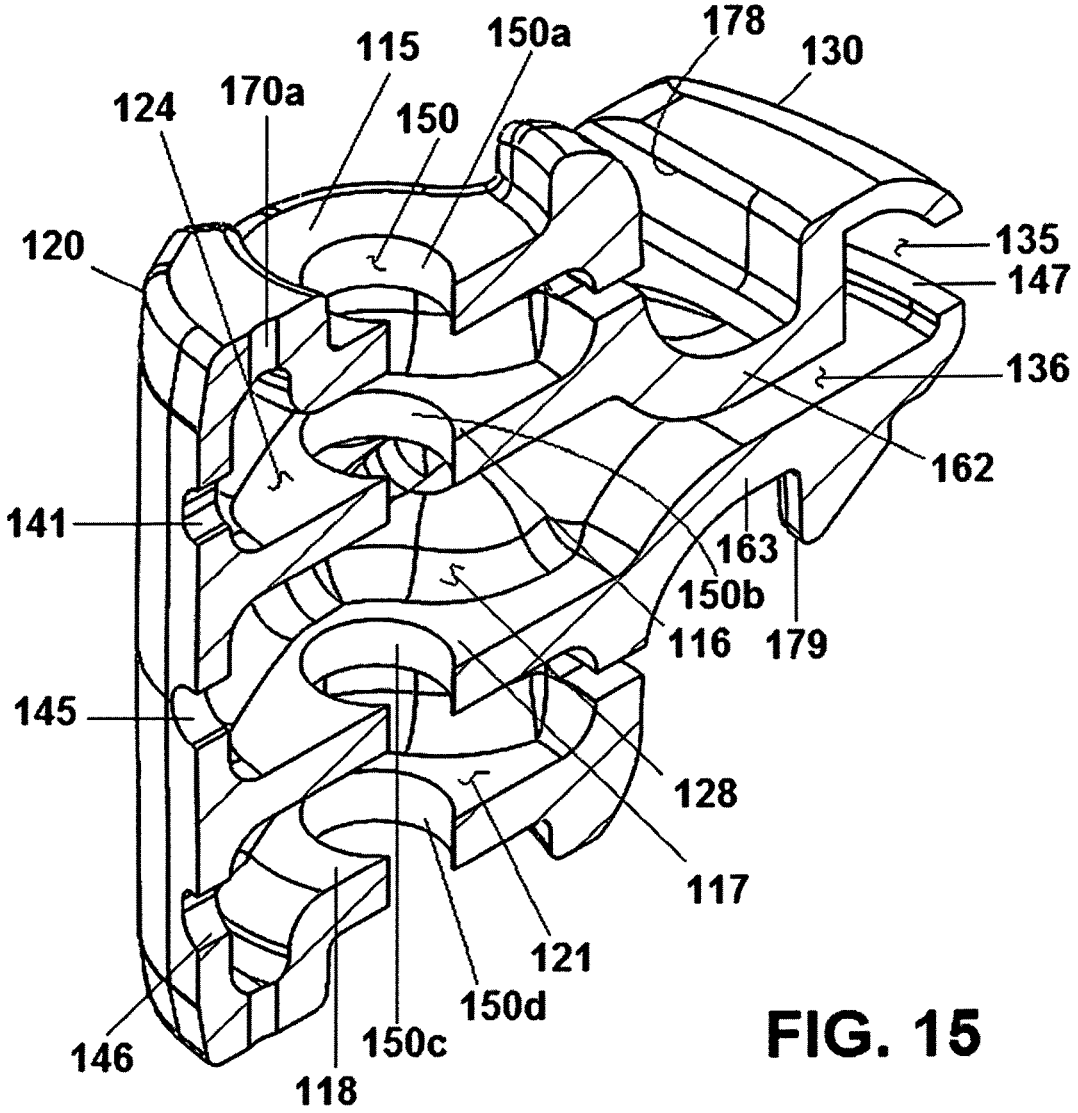
FIG. 15 is a sectional view thereof, in perspective, taken through the section line 15-15 of FIG. 2.

Once the refractory coating has been applied to the mold component sections 11,12,13,14 of the assembled mold 10, the mold cavities, such as those mold cavities 21,22,24,25, 28,35 are filled with an inert material. The inert material has a melting point higher than that of the material that will be used to form coupler knuckle. A preferred inert material is sand. The coated mold 10 may be placed in a suitable position, where it is secured, so that the sand may be introduced into the openings to fill the cavities. In the mold 10 shown and described, a preferred way to introduce the sand into the cavities, involves orienting the mold 10 in a vertical position, as shown in FIG. 7. The mold 10 may be placed in a holder, such as a jig, or a container surrounded by an inert material, such as sand. The fill material, such as sand, is then introduced to fill the mold cavities. Preferably, the sand is compacted to facilitate removal or minimization of air voids in the mold cavities. One way to accomplish this is to tamp the mold 10 or vibrate the mold 10 so that the sand will settle into the cavities. The mold 10 may be tamped or vibrated after sand is placed into the mold cavities, or as the sand is being introduced into the cavities. The introduction of sand into the mold cavities may be done with the aid of a vibration table, where the mold 10 is filled on, or placed on, a vibration table to compact the sand within the mold cavities.

Once the cavities of the mold 10 are filled with the inert material, such as sand, and the sand has been compacted, then the forming material or melt from which the coupler knuckle is to be constructed is introduced into the mold 10. The forming material preferably is introduced in a molten form. This may be accomplished by hand pouring the melt into the mold 10 or with the use of a filling machine that delivers the molten material to the mold 10. The molten forming material is introduced into the mold 10, and preferably is provided to contact the foam portion forming the mold, and to take up residence within the refractory coating. The forming material, preferably is added to the mold 10 in its molten form. The forming material preferably is provided to the mold 10 at or near one or more of the plurality of mold openings, such as, for example, the nose openings, 41,42, 43,44,45 or tail opening 47. According to preferred embodiments, the openings and cavities that communicate therewith, generally, at this stage of the process are occupied by sand. According to one preferred method, the mold 10 is held in a vertical position (such as its position in FIG. 5 as it appears on the page), and the melt is introduced into the mold 10 at or near the tail opening 47. Alternatively, the filling may be done from the nose section 20, with the melt introduced at or near the nose openings, 41,42,43,44,45. The previously applied refractory coating of the coated mold 10 forms the mold exterior and the mold interior. The mold interior defines the cavities of the mold 10. The introduction of the molten forming material contacts the mold 10 and the mold component sections 11,12,13,14 of which the mold 10 is comprised (which are between the refractory coating of the mold exterior and mold interior). The mold 10 and mold component sections 11,12,13,14 are decomposed when contacted by the forming material. The forming material fills the space between the coating that the mold component sections 11,12,13,14 occupied before contact with the melt. The forming material may be allowed to cure and set to form the coupler knuckle. The formed coupler knuckle has the shape and volume of the mold 10 from which it was formed. The material used to form the coupler knuckle therefore takes the place of the mold component sections 11,12,13,14 to form a coupler knuckle that has a shape corresponding to that of the arranged mold component sections 11,12,13,14.

According to one preferred embodiment, the forming material is treated by a treatment process, and preferably a process to strengthen the material, and to provide a suitable microstructure in the formed coupler knuckle product which has improved resistance to fatigue and cracking, and which may be lighter as well. Preferably, the treatment process involves an austenitizing process, by which the formed coupler knuckle is an austempered material. For example, the forming of the coupler knuckle may involve applying a suitable austenitizing process to the molten forming material when the coupler knuckle is being formed. One preferred method involves heating the molten metal, such as, for example ductile iron to an austenitizing temperature, and then quenching the material, such as in a salt bath or other heat extraction composition. The austenitizing process may be applied to the molten material introduced into the mold 10 (e.g., the material that is to form the coupler knuckle). Alternatively, the coupler knuckle may be formed from steel or other suitable metal, including, for example, grade E steel traditionally used to form knuckles.

Some other preferred examples of materials that may be used in accordance with the invention to form the coupler knuckle with the mold 10, include austempered metal, such as, for example, austempered ductile iron, austempered steel and austempered alloy steel, as well as alloys of these materials. Austempered ductile iron may include ductile iron alloyed with one or more metals, such as, for example, nickel, molybdenum, manganese, copper and mixtures thereof.

Once the forming material has been provided to fill the mold space, and any treatment such as austenitizing has taken place, the formed coupler knuckle is cured. The coupler knuckle formed is now between the refractory coating, which in on the interior of the coupler knuckle and on the exterior of the coupler knuckle. The inert material, such as sand, may still occupy the cavities (which are on the interior of the refractory coating). The formed coupler knuckle is then separated from the sand and the refractory coating. The configuration promotes the flow of sand not only into the mold cavities, but also out of the mold after use and out of the knuckle, when formed. The sand occupying the cavities may be removed through one or more of the openings. The refractory coating (e.g., the ceramic) may be broken apart from the coupler knuckle to expose the coupler knuckle, which is a knuckle that resembles the mold 10.

The method preferably permits the mold material to remain in its form, the mold 10 formed from the mold component sections 11,12,13,14, until the material forming the coupler knuckle is introduced into the mold 10 and to contact the mold material. The mold 10 and mold components 11,12,13,14 preferably are allowed to remain in the ceramic enclosure created by coating the mold 10. According to a preferred embodiment of the process, the mold 10 does not require removal from the ceramic material, nor is there a separate bake-out step required to remove the mold 10. Rather, the material that is to form the coupler knuckle, such as molten metal or melt, is introduced into the mold 10 within the ceramic enclosure coating the mold 10, while the mold 10 (and mold component sections 11,12,13,14 from which the mold 10 is formed) remain present. The coating of the invention, for example, a refractory ceramic coating, is permeable to the decomposition by products of the mold composition. For example, the foamed polyethylene, when contacted with the molten metal of the forming composition (which is used to form the resultant coupler knuckle) melts and decomposes, forming a gaseous product. The gas exits the mold or coating. Accordingly, the present process is less time consuming, as the molten knuckle forming material may be introduced into the mold 10 without requiring a removal step to remove the mold component sections 11,12, 13,14. According to the invention, the knuckle formed preferably has improved construction and surface characteristics, as the possibility of leaving behind material that is not removed from the mold is eliminated or greatly minimized.

Although not shown, an alignment mechanism, such as, for example, alignment elements may be provided on the mold sections to align the mold component sections 11,12, 13,14 together in a desired configuration. The alignment elements may include pins and holes provided at one or more locations on the mold component sections 11,12,13,14, and preferably on the contacting surfaces thereof, so that the pins will fit into the respective pin holes to ensure alignment of the mold component sections 11,12,13,14 in the desired shape of the coupler knuckle.

According to an embodiment of the invention, an improved coupler knuckle 110 is provided. The improved coupler knuckle 110 may be constructed through prior methods, or, preferably from the method illustrated and described herein, such as, the foam replacement method. The improved coupler knuckle 110, according to a preferred embodiment, has an improved interior configuration for facilitating improved force handling. According to preferred embodiments, an improved coupler knuckle may be produced having a configuration for linearly managing load. The coupler knuckle 110 preferably manages the force transmissions in a linear or substantially linear direction through the length of the knuckle.

The improved coupler knuckle 110 is illustrated in the drawing FIGS. 9-15. The coupler knuckle 110 includes a force handling structure, which preferably has one or more transverse layers that span across the knuckle interior, and which are separated by cavities. Similar to the mold 10 shown and described herein, the knuckle 110 has a plurality of interior cavities, including nose cavities, such as the nose cavities 121,124 and 128 and tail cavity 135 shown in FIG. 12. In addition, nose cavities corresponding to the mold cavities 22,25 (of FIG. 1) also may be provided in the knuckle 110.

The knuckle 110 preferably is constructed with an improved force handling construction, which preferably, includes a plurality of ribs or layers 115,116,117,118 which are separated by cavities therebetween, including the cavities 124,125,128,121,122. The layers include an upper layer 115 which is shown forming an upper surface of the top of the knuckle 110, and a lower layer 118 forming a lower surface of the bottom of the knuckle 110. A first wall section 126 separates the upper cavities 125,125, and a second wall section 123 separates the lower cavities 121,122. A mid cavity 128 is shown between the mid layers 116,117. According to a preferred embodiment, the mid layers 116, 117 are disposed for alignment in a direction of anticipated and expected pulling forces, when the knuckle 110 is employed on a railroad car coupling, and a pulling force is exerted on the knuckle 110. The mid layer 116 is shown disposed for alignment with the upper portion 160 of the tail 130, and the mid layer 117 is shown disposed for alignment with the lower portion 161 of the tail 130. Preferably, the knuckle 110 includes an upper wall 162 and a lower wall 163 which preferably extend from the nose section 120 to the tail section 130. A cavity 135 is provided in the tail section 130, and the tail section has an opening therein 147. The tail cavity 135 connects with a cavity or channel 136, which is shown communicating with a nose cavity, and preferably the mid cavity 128. A first sidewall portion 166 and second sidewall portion 167 are provided between the nose portion 120 and tail portion 130, and are shown defining the channel or cavity 136. The ribs or layers 115,116,117,118, according to a preferred configuration, are transversely spaced apart and separate the cavities in the knuckle 110, with adjacent layers defining a cavity between those layers. The coupler knuckle 110 includes a locking face 119 provided at the tail portion 130.

The coupler knuckle 110 includes a plurality of openings 141,142,143,144,145 provided in the nose section 120. The openings 141,142,143,144,145, respectively, communicate with and open into the respective nose cavities 121,122,124, 125,128. The knuckle 110 further is shown having openings 131,132,133 on or near the throat wall 146.

A pin bore 150 is shown formed in the knuckle 110. The pin bore 150 is formed in each of the spaced apart layers 115,116,117,118, each respective layer being shown with a bore 150*a*,150*b*,150*c*,150*d*, respectively, provided therein. The bores 150*a*,150*b*,150*c*,150*d* are aligned to form a continuous pin bore 150 extending through the knuckle 110. In the embodiment of the knuckle 110 illustrated, the cavities 124,128,121 are shown communicating with the pin bore 150. A flag hole 170 is provided in the knuckle 110 and preferably extends into the top layer 115 thereof. The flag hole 170 may extend into the knuckle and preferably may be formed by a plurality of flag holes 170*a*,170*b*,170*c* provided in the respective layers 115,116,117. The flag hole 170 may extend to or into the lower layer 118, but not through it, while in alternate embodiments, the flag hole 170 may pass through the bottom of the knuckle 110, or into it without extending through it.

Pulling lugs 178,179 are provided on the tail section 130. According to a preferred embodiment, the upper pulling lug 178 is illustrated being transversely aligned in a pulling direction and being aligned with the first mid layer 116. The lower pulling lug 179 is illustrated being transversely aligned in a pulling direction and being aligned with the second mid layer 117. The upper lug 178 is shown connecting with the upper wall 162 and the lower lug 179 is shown connecting with the lower wall 163. According to the preferred embodiment illustrated, the upper lug 178 is shown spaced apart from the lower lug 179, and preferably is spaced by the channel 136.

According to a preferred construction, the transverse ribs or layers 115,116,117,118 are provided along a path parallel to the anticipated force direction that the knuckle 110 handles when a pulling force is applied to the knuckle 110.

The knuckle 110 preferably is constructed to improve force handling and provide improved resistance to fatigue. The improved construction of the knuckle 110 includes force handling means for transferring the forces imparted on the knuckle 110 through the knuckle 110 so the forceloads may be linearly managed. The knuckle 110 may receive a load from other knuckles to which the knuckle 110 is coupled or the vehicle to which the knuckle 110 is connected, such as through a coupler. For example, the knuckle 110 may be installed in a coupler where the knuckle is pivotally mounted at the coupler head. The coupler head engages the knuckle and places a load thereon during operation of the components. Preferred configurations of the knuckle provide a load bearing framework, which includes a preferred configuration within the knuckle interior that facilitates linear management of a forceload. The knuckle 110 is shown having a preferred force handling structure. The knuckle 110 also is constructed and designed to resist fatigue and cracking According to some embodiments, knuckles produced with the method of the present invention may be constructed having heights, lengths and widths similar to those of standard coupler knuckles. According to some preferred embodiments, knuckles may be constructed in accordance with the invention having preferred dimensions. The method preferably may be implemented to produce knuckles having improved surface finishes to contribute to providing higher fatigue strength for the knuckle. For example, the method may be used to produce a knuckle with a surface finish of about 125-175 RMS. According to some preferred embodiments, knuckles may be constructed having wall thicknesses preferably from between about 0.25 in. and about 1.5 in., and more preferably from between about 0.25 in to 1.25 in. In addition, according to some preferred embodiments, the coupler knuckles may be produced having some or all of the advantages discussed herein and meet the AAR specification, M-216.

These and other advantages may be realized with the present invention. While the invention has been described with reference to specific embodiments, the description is illustrative and is not to be construed as limiting the scope of the invention. For example, although the method and mold refer to gaseous by products exiting the mold through the refractory coating, the mold by products may exit the mold through the openings formed in the mold and mold component sections. The mold design preferably allows the inert material or sand to flow through the mold so that the cavities may be filled to produce the knuckle and emptied after the component has been formed. Preferred embodiments provide communicating cavities in the mold. Various modifications and changes may occur to those skilled in the art without departing from the spirit and scope of the invention described herein and as defined by the appended claims.

What is claimed is:

1. A method for producing a coupler knuckle provided for use as an in-service coupler knuckle, the method comprising:

forming a mold having a desired shape of the coupler knuckle to be produced, said mold having at least one cavity therein and at least one opening therein;

the mold having a plurality of mold component sections, wherein said mold component sections are arrangeable together to form a representation of the desired shape of the coupler knuckle to be produced;

wherein said at least one cavity communicates with an exterior of the mold through the at least one opening;

wherein said mold component sections are formed from a consumable material;

arranging the plurality of mold component sections to form the shape of the coupler knuckle to be produced, the mold component sections when arranged forming said at least one cavity and forming the at least one opening in said mold that communicates with said at least one cavity;

wherein the arranged mold component sections define an interior mold surface formed therefrom, and wherein the arranged mold component sections define an exterior mold surface of the mold exterior formed therefrom, wherein said at least one cavity is formed by the interior mold surface;

applying a refractory coating to the interior and the exterior mold surfaces of said arranged mold component sections to form the mold;

placing said mold formed from said arranged mold component sections in a secured arrangement for receiving a first material and a second material;

introducing a first material into the at least one cavity to occupy the at least one cavity;

introducing a second material into the mold to contact the mold component sections and to consume said mold component sections;

wherein said second material takes the place of said mold component sections to form a coupler knuckle having a shape corresponding with the arranged mold component sections;

wherein arranging the plurality of mold component sections includes aligning the mold component sections to form a vertical passageway therethrough comprising a continuous pin bore that passes through each of said mold component sections; and wherein each of said mold component sections has a horizontal shelf portion, which, when said mold component sections are aligned, defines the vertical passageway; and wherein each said mold component section has a sidewall, wherein each said horizontal shelf portion joins with a sidewall of a said mold component section;

wherein the vertical passageway comprising the continuous pin bore comprises a cylindrical vertical passageway that is formed by a circumferential aperture in each of the respective horizontal shelf portions of the respective mold component sections, wherein when the mold component sections are arranged, the circumferential apertures align to form the pin bore, wherein said respective horizontal shelf portion in which said apertures are formed have a circumferential wall forming said respective aperture.

2. The method of claim 1, wherein said secured arrangement involves securing together the mold component sections.

3. The method of claim 2, wherein said mold component sections include alignment means for aligning the mold component sections together in a desired configuration.

4. The method of claim 1, wherein placing said mold formed from said arranged mold component sections in a secured arrangement includes supporting the formed mold in an inert material.

5. The method of claim 4, wherein said inert material comprises sand.

6. The method of claim 1, wherein said second material comprises steel.

7. The method of claim 1, including compacting the first material introduced into the at least one mold cavity.

8. The method of claim 7, wherein compacting is done by vibrating the mold and/or first material contained in the at least one mold cavity.

9. The method of claim 1, wherein a plurality of cavities are formed by arranging the mold component sections together, and wherein each of said plurality of cavities is accessible through at least one or more openings in the mold to receive said first material, and wherein the first material is introduced into each of the plurality of cavities.

10. The method of claim 1, wherein said mold component sections are formed by injection molding.

11. The method of claim 1, wherein said mold component sections are formed from a foam material.

12. The method of claim 11, wherein said mold component sections are formed from polystyrene foam.

13. The method of claim 10, wherein said mold component sections are formed from polystyrene foam.

14. The method of claim 1, wherein forming the coupler knuckle from the second material includes allowing the second material to cure to form a product, separating the first material from the cured second material product, and separating the refractory coating from said product.

15. The method of claim 1, wherein introducing the first material is done through the at least one opening.

16. The method of claim 1, wherein the first material is resistant to heat and has a melting point higher than that of the second material introduced into the mold to form the coupler knuckle.

17. The method of claim 1, wherein said first material is an inert material.

18. The method of claim 1, wherein said first material is sand.

19. The method of claim 4, wherein said first material is an inert material, and wherein said inert material in which the formed mold is supported is sand.

20. The method of claim 1, wherein the second material is a molten material, and wherein said refractory coating is applied to form a solid, shape retaining composition that has a melting point higher than that of the molten second material that is introduced into the mold to form the coupler knuckle.

21. The method of claim 1, wherein said refractory coating is ceramic.

22. The method of claim 1, wherein said refractory coating is permeable to the consumed mold component sections or byproducts thereof.

23. The method of claim 1, wherein said first material introduced into the at least one mold cavity is separated from contact with said mold component sections by said refractory coating.

24. The method of claim 1, wherein said second material is separated from said first material introduced into the at least one mold cavity by said refractory coating.

25. The method of claim 1, wherein the said plurality of mold component sections includes at least one upper mold component section, at least one lower mold component section and at least one mid mold component section, said mold having a plurality of cavities, with a cavity formed between each mold component section, and with a plurality of openings, wherein an opening communicates with at least one of said plurality of cavities, wherein said first material is introduced into said plurality of openings to occupy said plurality of cavities;

wherein the cylindrical vertical passageway that is formed by the circumferential aperture in each of the respective horizontal shelf portions of the respective mold component sections is formed in each of said at least one upper mold component section, said at least one lower mold component section and said at least one mid mold component section.

26. The method of claim 25, wherein said mold comprises four mold component sections including an upper mold section, a lower mold section and two mid mold sections comprising a first mid mold section and a second mid mold section, with a first pair of openings provided between said upper mold section and said first mid mold section, and mid opening provided between said first and second mid mold sections, and a second pair of openings provided between said second mid mold section and said lower mold section.

27. The method of claim 1, wherein said second material comprises an austempered metal.

28. The method of claim 27, wherein said austempered metal is austempered ductile iron.

29. The method of claim 27, wherein said austempered metal is selected from the group consisting of austempered ductile iron, austempered steel and austempered alloy steel.

30. The method of claim 28, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said coupler knuckle.

31. The method of claim 1, wherein said mold is formed using a die having the desired shape of the coupler knuckle to be produced, and wherein said die receives an injection of molding material used to produce the mold, and wherein steam is introduced into said molding material in said die to expand said molding material to a foamed material, and wherein said foamed molding material forms said mold having the desired shape of the coupler knuckle to be produced.

32. The method of claim 1, wherein said consumable material is a decomposable material, and wherein introducing the second material into the mold to contact the mold component sections and to consume said mold component sections decomposes the mold sections.

33. The method of claim 1, wherein the said plurality of mold component sections includes at least one upper mold component section, at least one lower mold component section and at least one mid mold component section, said mold having a plurality of cavities, with a cavity formed between each mold component section, and with a plurality of openings, wherein an opening communicates with at least one of said plurality of cavities, wherein said first material is introduced into said plurality of openings to occupy said plurality of cavities;

wherein said at least one mid mold component section includes said horizontal shelf portion;

including providing said mold component sections, wherein said mold component sections include at least one vertical wall that connects between said at least one mid mold component section and at least one of said upper mold component section and said lower mold component section; and forming, when the mold component sections are assembled together, said vertical wall between the respective mid mold component section and the respective one of said at least one of said upper mold component section and said lower mold component section;

wherein the cylindrical vertical passageway that is formed by the circumferential aperture in each of the respective horizontal shelf portions of the respective mold component sections is formed in each of said at least one upper mold component section, said at least one lower mold component section and said at least one mid mold component section.

34. The method of claim 33, including assembling the mold components together to connect said vertical wall to comprise a continuous wall span between at least one mid mold component section horizontal shelf portion and at least one said horizontal shelf portion of said upper mold component section and lower mold component section; each mold component section having a nose portion, a first sidewall portion, and a second sidewall portion, wherein said horizontal shelf portion of said mid mold section comprises a surface with a continuous span from the aperture in said shelf portion to each of said first sidewall portion, said second sidewall portion, and said nose portion.

35. The method of claim 1, wherein the interior mold surface defined by the arrangement of the mold component sections is the profile of the interior wall surfaces of the coupler knuckle to be produced, and wherein the exterior mold surface defined by the arrangement of the mold component sections is the profile of the exterior wall surfaces of the coupler knuckle to be produced.

36. The method of claim 33, wherein said mold comprises four mold component sections including an upper mold component section, a lower mold component section and two mid mold component sections comprising a first mid mold component section and a second mid mold component section, with a first pair of openings provided between said upper mold component section and said first mid mold component section, and a mid opening provided between said first and second mid mold component sections, and a second pair of openings provided between said second mid mold component section and said lower mold component section;

including providing said mold component sections, wherein said mold component sections include at least one first vertical wall that connects between at least one mid mold component section and said upper mold component section and at least one second vertical wall that connects between at least one other mid mold component section and said lower mold component section; and wherein assembling said mold component sections together forms said first and second vertical walls, respectively, between each of the respective mid mold component sections and a respective one of the upper mold component section and lower mold component section.

37. The method of claim 36, wherein said vertical walls comprise a first continuous wall span between said first mid mold section and said upper mold component section and a second continuous wall span between said second mid mold section and said lower mold component section.

38. The method of claim 2, wherein arranging the mold component sections includes arranging the mold component sections adjacent to one another, and wherein said mold component sections are secured together with an adhesive; wherein each mold component section comprises a horizontal section of the desired shape of the coupler knuckle to be produced.

39. The method of claim 38, wherein at least four mold component sections are assembled together to form the mold, said at least four mold component sections including at least one upper mold component section, at least one lower mold component section and at least one first mid mold component section, and at least one second mid mold component section;

said mold having a plurality of cavities, with cavities formed between adjacent mold component sections, the arranged mold component sections forming a plurality of openings, wherein each opening communicates with at least one of said plurality of cavities, wherein said first material is introduced into said plurality of openings to occupy said plurality of cavities.

40. The method of claim 34, said vertical wall producing in the completed knuckle a connection between a first horizontal layer of the knuckle corresponding to the horizontal shelf portion of the first mid mold component section and a second horizontal layer of the knuckle corresponding to the horizontal shelf portion of the second mid mold component section, and wherein said pin bore passageway passes through the first and second horizontal layers.

* * * * *